United States Patent [19]

Cashio

[11] 4,340,333

[45] Jul. 20, 1982

[54] CONCRETE PIPE HANDLING APPARATUS

[76] Inventor: R. Kent Cashio, Rte. 6, Box 387, Baton Rouge, La. 70815

[21] Appl. No.: 846,547

[22] Filed: Oct. 28, 1977

Related U.S. Application Data

[63] Continuation-in-part of Ser. No. 737,187, Nov. 1, 1976, abandoned.

[51] Int. Cl.[3] ..... B66F 9/12

[52] U.S. Cl. ..... 414/607; 414/23; 414/910

[58] Field of Search ..... 214/620, 130 C, 145, 214/3, DIG. 3, DIG. 4, 621

[56] References Cited

U.S. PATENT DOCUMENTS

| | | | |
|---|---|---|---|
| 3,286,855 | 11/1966 | Bill | 214/3 |
| 3,352,433 | 11/1967 | Moore | 214/145 |
| 3,448,880 | 6/1969 | Howard | 214/620 |
| 3,512,670 | 5/1970 | Howard | 214/620 |
| 3,850,317 | 11/1974 | Lumier | 214/DIG. 4 |

*Primary Examiner*—Joseph F. Peters, Jr.
*Assistant Examiner*—Ross Weaver

[57] ABSTRACT

An apparatus for lowering and raising concrete pipe from a vertical position comprising an open ring plate pivotedly mounted on a vehicle having a lifting assembly to raise and lower the open ring plate.

3 Claims, 6 Drawing Figures

CONCRETE PIPE HANDLING APPARATUS

RELATED APPLICATIONS

This is a continuation-in-part of U.S. Patent Application Ser. No. 737,187, filed Nov. 1, 1976, now abandoned, by the inventor herein and entitled "Concrete Pipe Handling Apparatus", and all disclosures therein are intended to be a part hereof for purposes of obtaining the benefit of the earlier filing data.

BACKGROUND OF THE INVENTION

1. Field of the Invention

This invention relates to apparatus for handling pipe, and more particularly to an apparatus that can lower or raise non-cured concrete pipe from its vertical position as it is first removed from a forming machine to a horizontal position for storage and curing.

2. Prior Art

In most cases, concrete pipe is formed in a vertical position. When it is first removed from the forming machine, it is quite fragile and must be moved to a storage area so that it may "cure" or harden. Because of the large size, bulkiness, weight and fragility of the "green" or non-cured concrete pipe, movement to a "curing" area creates a severe problem if the pipe is not to be chipped or crushed.

Present techniques for moving the green pipe utilize a tractor device having fingers which grab and squeeze the pipe before lifting. However, this results in many broken pipes because the squeezing action many times crushes the fragile and brittle pipe. Other techniques used include tipping the green pipe by hand to a horizontal position and then rolling it to the curing area. This technique is also undesirable because it is slow, requires a great deal of manpower, results in injuries to personnel and many times results in cracks and chips in the lip or shoulder section of the pipe.

SUMMARY OF THE INVENTION

Therefore, an object of this invention is to provide an apparatus that can move non-cured concrete pipe without crushing, cracking or chipping the pipe.

Other objects and advantages of this invention will become apparent from the ensuing description of the invention.

Accordingly, an apparatus having an open ring plate pivotedly mounted on a frame assembly attached to a lifting means of a vehicle wherein the open ring plate can fit about and more than halfway around the outside diameter of the concrete pipe to be moved.

PREFERRED EMBODIMENTS OF THE INVENTION

Most concrete pipe is formed in vertical molds which, when removed, leave the concrete pipe standing on its flared end. In order to form another pipe, it is necessary to remove the first pipe to a storage area where the concrete in the pipe can complete its hardening or "curing". As seen in FIGS. 1–6, an apparatus for moving the newly formed or "green" pipe is provided comprising generally an open ring plate assembly 1 pivotedly attached to a frame assembly 2 which can be vertically moved by conventional lifting means 3 such as found on a forklift truck 4.

Figure 5:
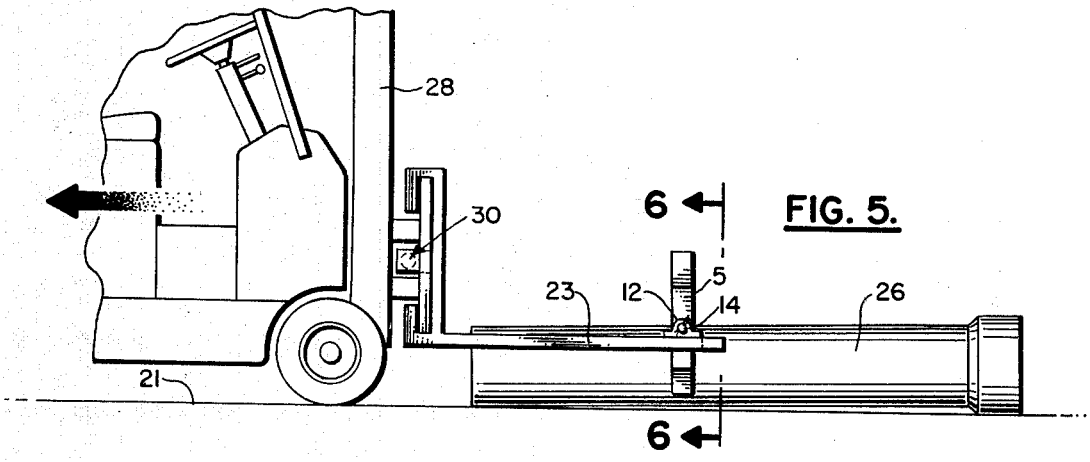
Figure 3:
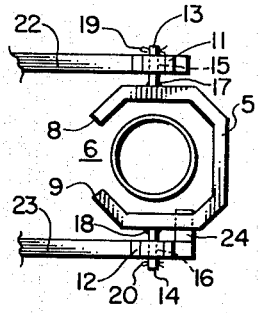
FIG. 3 is a cross-sectional view taken along lines 3—3 in FIG. 2 illustrating the stopping means control of the rotation of the open ring plate.
Figure 6:
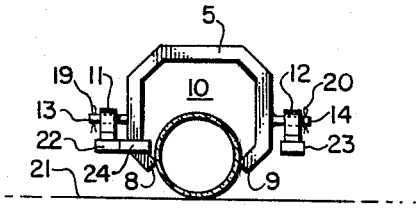
FIG. 6 is a cross-sectional view taken along lines 6—6 of FIG. 5 illustrating the relational position of the apparatus and pipe when the pipe is in a horizontal position.

More particularly, plate assembly 1 is constructed from a steel bar 5 that is curved to form a ring having an opening 6. Opening 6 has a diameter less than the outside diameter of the concrete pipe 7 to be moved. Preferably, opening 6 will be sufficiently large so that plate 1 can fit about pipe 7 even when it is lying in a horizontal position on floor 21 as seen in FIGS. 5 and 6. More preferably, plate edges 8 and 9 will engage pipe 7 so that at least two-thirds and most preferably three-fourths of the circumference of pipe 7 is in cavity 10 of plate assembly 1.

Plate assembly 1 pivotedly attaches to shoulder members 11 and 12 of frame assembly 2 by rods 13 and 14 which extend through collar bearing means 15 and 16 in shoulder members 11 and 12, respectively, to bar 5. Rods 13 and 14 are held in position by cotter pins 19 and 20 in a conventional manner. Shoulder members 12 and 13 are attached at one end of extension arms 22 ans 23, respectively, which extend away from plate 1 and attach to lifting means 3 in any conventional manner.

In order to facilitate positioning plate assembly 1 about pipe 7, extension arm 23 is provided with a stopping means 24 which comprises a metal bar extension 25 attached to arm 23 on the opposite side of shoulder member 12 from lifting means 3.

Figure 1:
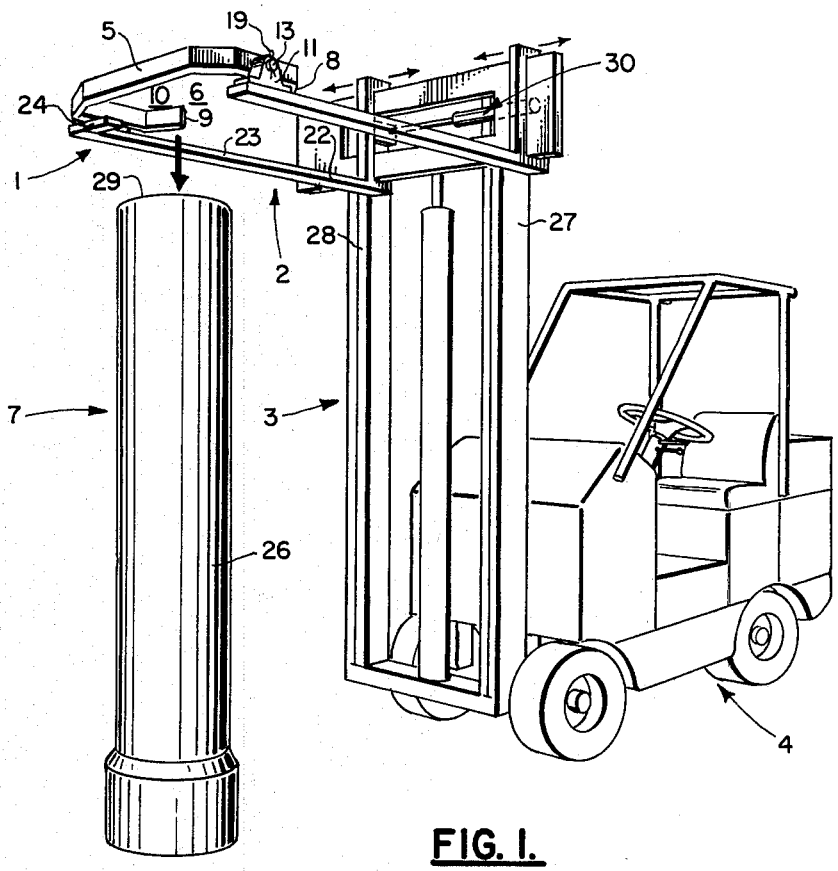
FIG. 1 is a three-quarter frontal perspective view of a preferred embodiment of this invention fitted about a concrete pipe to be moved.
Figure 2:
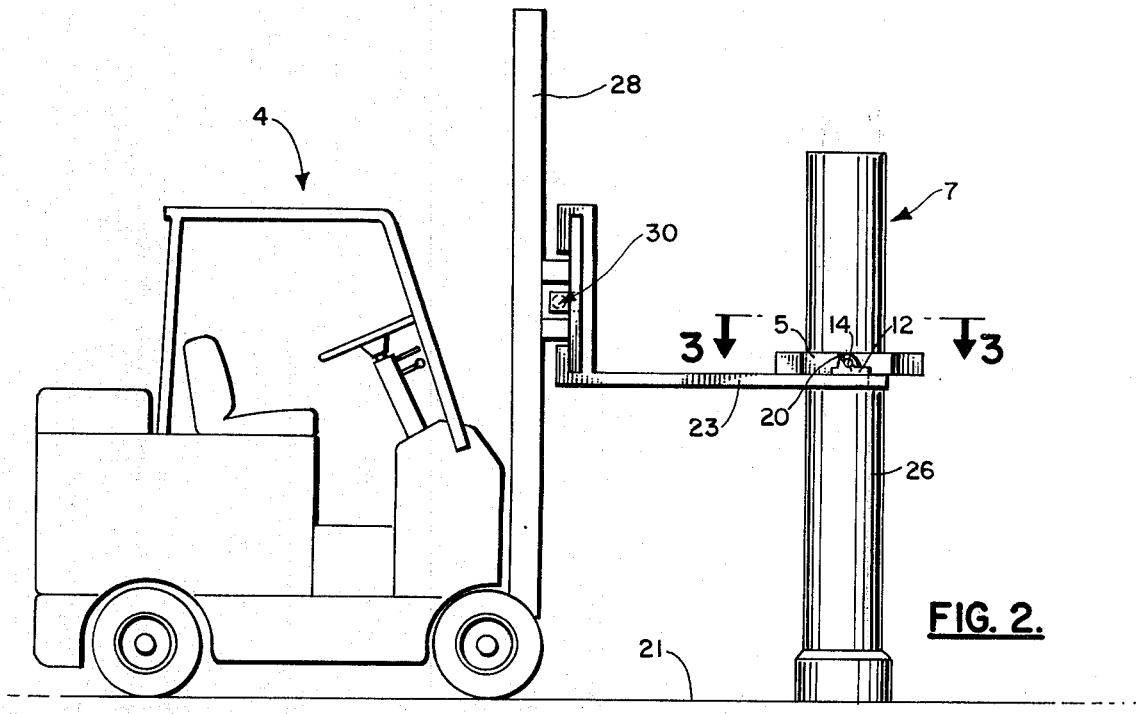
FIG. 2 is a side perspective view of a preferred embodiment of this invention.
Figure 4:
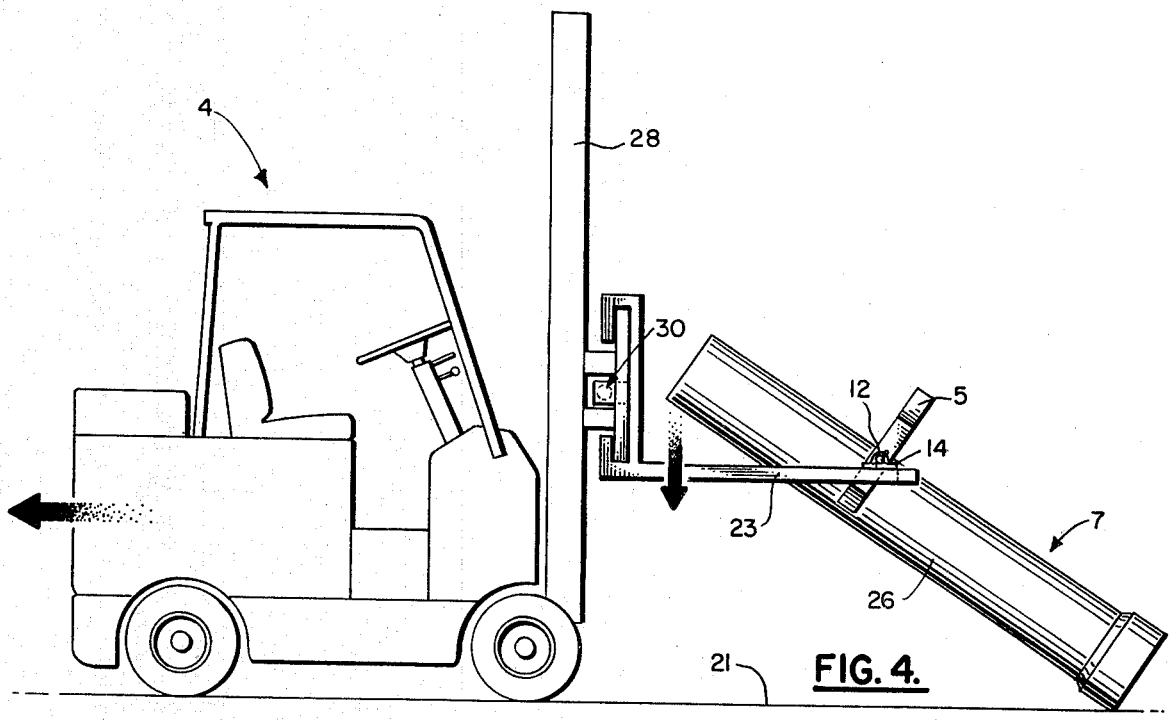
FIGS. 4 and 5 illustrate the handling of the pipe in a tipped and horizontal position, respectively.

In operation, forklift truck 4 is driven in position and lifting means 3 (e.g., hydraulic lift) raises frame assembly 2 above top edge 29 of pipe 7. In a preferred feature, forklift 4 will also be provided with a horizontal adjusting means 30 (e.g., hydraulically operated piston) for horizontally positioning of extension arms 22 and 23. Bar 5 will lay in a horizontal position on top of stopping means 24 as shown in FIG. 1. Lifting means 3 then lowers bar 5 about pipe mid-section 26, and, next, forklift 4 backs away from pipe 7 causing pipe 7 to tip over as shown in FIG. 2. Forklift truck 4 continues to back away until pipe 7 rests on vertical members 27 and 28 of lifting means 3. Pipe 7 can then be dragged to the storage area for curing. If it is desired to lay pipe 7 flat on floor 21, then bar 5 is positioned further up on pipe mid-section 26 so that pipe end 29 will pass between extension arms 22 and 23 as seen in FIGS. 4 and 5. By reversing the above procedures, pipe 7 can be raised from a horizontal position to a vertical position. As can be seen in either the lowering or raising of the pipe 7, there is no grabbing or squeezing pressure exerted against the pipe mid-section 26, thereby substantially reducing damage to pipe 7.

There are, of course, many alternate embodiments to the construction concrete pipe handling apparatus disclosed and it is intended that these embodiments be included within the scope of this invention.

What I claim is:

1. An apparatus for moving non-cured concrete pipe of particular diameter and attachable to a lifting means of a vehicle which comprises:

(a) a frame assembly attached to said vehicle, and (b) an open ring plate pivotedly mounted to said frame assembly, said open ring plate formed by a single side member of said plate to form a center cavity having a diameter greater than said pipe and sufficient to pass over said pipe without contacting said pipe, said side member extending less than completely about said pipe but extending around said pipe to create an opening less than said pipe's diameter.

2. An apparatus according to claim 1 wherein said side member extends at least two-thirds around said pipe.

3. An apparatus according to claim 1 wherein said side member has a stopping means protruding from said side member at an angle and distance to contact said frame assembly to restrict said plate's pivoting to less than about 90°.

* * * * *